US008955847B2

(12) United States Patent
Syse et al.

(10) Patent No.: US 8,955,847 B2
(45) Date of Patent: Feb. 17, 2015

(54) SEALING ARRANGEMENT FOR A DOWN HOLE VALVE

(75) Inventors: Harald Syse, Royneberg (NO); Stein Erik Meinseth, Stavenger (NO)

(73) Assignee: Reelwell AS (NO)

( * ) Notice: Subject to any disclaimer, the term of this patent is extended or adjusted under 35 U.S.C. 154(b) by 267 days.

(21) Appl. No.: 13/262,919

(22) PCT Filed: Apr. 16, 2010

(86) PCT No.: PCT/NO2010/000143
§ 371 (c)(1),
(2), (4) Date: Jan. 30, 2012

(87) PCT Pub. No.: WO2010/120191
PCT Pub. Date: Oct. 21, 2010

(65) Prior Publication Data

US 2012/0112115 A1 May 10, 2012

(30) Foreign Application Priority Data

Apr. 17, 2009 (NO) ..... 20091531

(51) Int. Cl.
*E21B 33/10* (2006.01)
*E21B 33/128* (2006.01)
*E21B 34/06* (2006.01)
(Continued)

(52) U.S. Cl.
CPC ..... *E21B 34/06* (2013.01); *E21B 2033/005* (2013.01); *E21B 2034/007* (2013.01)
USPC ..... 277/339; 277/336; 277/637; 251/333

(58) Field of Classification Search
USPC ..... 166/387; 251/157, 158, 333, 343, 347; 277/339, 340, 609, 630, 637, 336
See application file for complete search history.

(56) References Cited

U.S. PATENT DOCUMENTS 3,381,969 A * 5/1968 Crow et al. ..... 277/340
4,953,617 A 9/1990 Ross et al.
(Continued)

FOREIGN PATENT DOCUMENTS

DE 2637028 A1 2/1978
GB 2327691 A 2/1999

OTHER PUBLICATIONS

International Preliminary Report on Patentability in PCT/NO2010/000143, issued Oct. 18, 2011.
(Continued)

*Primary Examiner* — John K Fristoe, Jr.
*Assistant Examiner* — Kevin Barss
(74) *Attorney, Agent, or Firm* — Adenike Adebiyi

(57) ABSTRACT

The present invention regards a sealing arrangement for a valve, comprising a valve element (3) provided with a sealing element (4), arranged to be abutting a valve seat (2) in a closed state of the valve. The valve element (3) comprises at least two parts, a first and second part (31,32), each comprising an abutting surface (310,320), which abutting surfaces (310, 320) are arranged facing each other and to abut against corresponding sealing element surfaces (41,42) of the sealing element (4), and whereof at least one part (31) of the valve element (3) is being arranged to be moveable relative another part (32) of the valve element (3) and the at least one part (31) of the valve element (3) comprises a pressure surface (311) exposed to a surrounding fluid in a closed state of the valve giving pressure on the sealing element (4) responsive to the pressure in the surrounding fluid.

5 Claims, 4 Drawing Sheets

(51) Int. Cl.
*E21B 33/00* (2006.01)
*E21B 34/00* (2006.01)

(56) References Cited

U.S. PATENT DOCUMENTS

| | | | | |
|---|---|---|---|---|
| 5,997,003 | A | 12/1999 | Turner | |
| 7,320,367 | B2 * | 1/2008 | Brezinski et al. | 166/387 |
| 2003/0079887 | A1 * | 5/2003 | Lloyd et al. | 166/387 |
| 2003/0193145 | A1 * | 10/2003 | Reimert et al. | 277/336 |
| 2005/0241710 | A1 * | 11/2005 | Early et al. | 138/89 |
| 2006/0243457 | A1 * | 11/2006 | Kossa et al. | 166/387 |

OTHER PUBLICATIONS

Norwegian Search Report in NO 20091531, issued Nov. 6, 2009.
International Search Report in PCT/NO2010/000143, issued Oct. 6, 2010.

* cited by examiner

SEALING ARRANGEMENT FOR A DOWN HOLE VALVE

FIELD

The present invention regards a sealing arrangement for a down hole valve.

BACKGROUND

In a well there are several fluid paths which need to be closed and opened depending on the activities in the well. There may be high temperatures and pressures, abrasive fluids, etc within a well which can make a safe operation of a valve difficult. In addition there may be temperature and pressure variations in the well and a valve should be safely operable within a given range of both temperatures and pressures, thereby giving that the sealing arrangement in connection with such a valve must withstand these variations and still provide a closed valve.

SUMMARY OF INVENTION

An aim with the present invention is to provide a sealing arrangement which provide a closed valve for a relative large pressure range, and this is achieved with a sealing arrangement as defined in the claims.

The present invention regards a valve sealing arrangement. The valve comprises a valve element provided with a sealing element, where the sealing element is arranged to be abutting a valve seat of the valve in a closed state of the valve. The closed valve closes off a fluid path, while the fluid path is open and allows the passage of fluid in an open state of the valve.

According to the invention the valve element comprises at least two valve element parts, a first part and a second part. The first part of the valve element is arranged moveable relative the second part of the valve element. Both the first and the second part comprises an abutting surface, which abutting surfaces are arranged facing each other and to abut against corresponding sealing element surfaces of the sealing element. The first part of the valve element comprises in addition a pressure surface exposed to a surrounding fluid in a closed state of the valve thereby transferring pressure from the surrounding fluid through the first part to the sealing element. The surrounding fluid is the fluid for which the valve is closing the fluid path. The first part is, when the valve is moved from an open state to a closed state, moved relative the second part such that the abutting surfaces are moved towards each other. This movement of the first part will give a pressure in the sealing element which is positioned between the abutting surfaces. In a closed state of the valve the first part is moved so that the abutting surfaces are in an initial relative position defined by the configuration of the valve element and the valve seat, thereby giving an initial pressure within the sealing element. The first part is in the closed state of the valve also movable relative the second part so that the abutting surfaces may be moved further towards each other, thereby increasing the pressure within the sealing element. This further movement of the first part will depend on the pressure of the fluid on the pressure surface of the first part in relation to the sealing pressure in the sealing element.

By such an arrangement there is provided a sealing arrangement in the valve which is pressure sensitive in relation to the fluid surrounding the valve, in that an increase in pressure in the fluid will possibly increase the sealing pressure in the sealing element, if this exceed the initial pressure in the sealing element. This because the first part of the valve element, comprising the pressure surface is arranged movable relative the second part and the sealing element is arranged between the first and the second part, a movement of the first part due to an increase in pressure will give an increased pressure from the first part to the sealing element and thereby an increased sealing pressure in the sealing arrangement. The sealing arrangement is by this safely operable for a range of pressures in the fluid for which the valve is closing the fluid path.

According to one aspect of the invention the pressure surface of the first part may have a larger area exposed to the fluid pressure than an area of the abutting surface in contact with the sealing element seen along one axis. This will give that a pressure increase in the fluid is increased by the difference in the areas of the pressure surface divided by the abutting surface, towards the sealing element. The result of this is that the pressure within the sealing element will always be larger than the pressure in the fluid, thereby providing a good sealing of the fluid path for a range of fluid pressures.

According to another aspect the valve seat may be exposed to fluid flowing through the valve in an open state of the valve.

According to another aspect the abutting surfaces of the two parts of the valve element may be formed as angular abutting surfaces in relation to a central axis. The abutting surfaces may in a cross section form a partly V-shape. According to one embodiment the open end of the V-shape may be facing away from the valve seat. Such an arrangement will form a dove tail groove configuration between the first part and second part of the valve element. In another embodiment it is possible that the open end of the V-shape is facing the valve seat.

According to another aspect the second part of the valve element may comprise a guiding part in abutment with a gliding surface of the first part of the valve element allowing relative movement between the parts. These, guiding part and gliding surface, may comprise means for keeping the parts together but allowing them to move relative each other in one direction, as for instance T-shaped tongue and grooves.

According to another aspect the first part of the valve element may comprise a stopping surface for abutment against a stopping seat of an element forming the valve seat. The abutment between the stopping seat and stopping surface will prevent further movement of the first part in one direction. When the valve element is in an open state of the valve the stopping surface and the stopping seat are arranged in distance from each other. When the valve element is moved to a closed state of the valve the stopping surface comes in abutment against the stopping seat and the first part is moved so that the abutting surfaces of the first and second part are moved towards each other, thereby creating a pressure within the sealing element. When the valve is in a closed state there will be an initial pressure in the sealing element, as the first part is pressured towards the sealing element by the interaction between the stopping surface and the stopping seat and the second part is pressed towards the sealing element from the opposite side by the movement of the valve element from an open to a closed position.

According to another aspect of the invention the second part of the valve element may comprise a protective section. This protective section is arranged upstream of the first part in a normal flow direction through the valve. This protective section is configured to cover at least a part of the pressure surface of the first part from the flow of fluid through the valve in an open state of the valve. The protective section is also configured to allow fluid to act on the pressure surface in a closed state of the valve. Such a protective section will prevent the activation of the sealing element in an open state of the valve, due to the flow of fluid through the valve. A flowing fluid will due to its velocity give a pressure on a pressure surface when the fluid flow hits a surface in addition to the pressure within the fluid. By having the protective section one is preventing the fluid flow from having such a large influence on the pressure surface that the sealing arrangement is partly activated and thereby moves the first part towards the sealing in an open state of the valve.

According to an aspect the sealing element is an annular shaped sealing element. The annular shaped sealing element may be mainly circular, elliptic, polygonal etc The annular shaped sealing element may be formed with a mainly triangular cross section, polygonal cross section or other form in a non-stressed formed. The cross section if the sealing element may change when the valve is moved from an open state to a closed state.

According to an aspect the valve seat is formed by a sleeve element. In one embodiment the valve element may also be formed as a sleeve element, in another embodiment the valve element may be formed by a plug element, within a sleeve element forming the valve seat. In one embodiment the sealing element in a closed state of the valve is pressed against the valve seat arranged radially outwards of the sealing element. In another embodiment the sealing element in a closed state of the valve is pressed against the valve seat arranged radially within the sealing element. In these last embodiments the valve element may be moved axially to move the valve between an open state and a closed state.

BRIEF DESCRIPTION OF DRAWINGS

The present invention will now be explained with reference to the accompanying drawings where.

DETAILED DESCRIPTION

Figure 1:
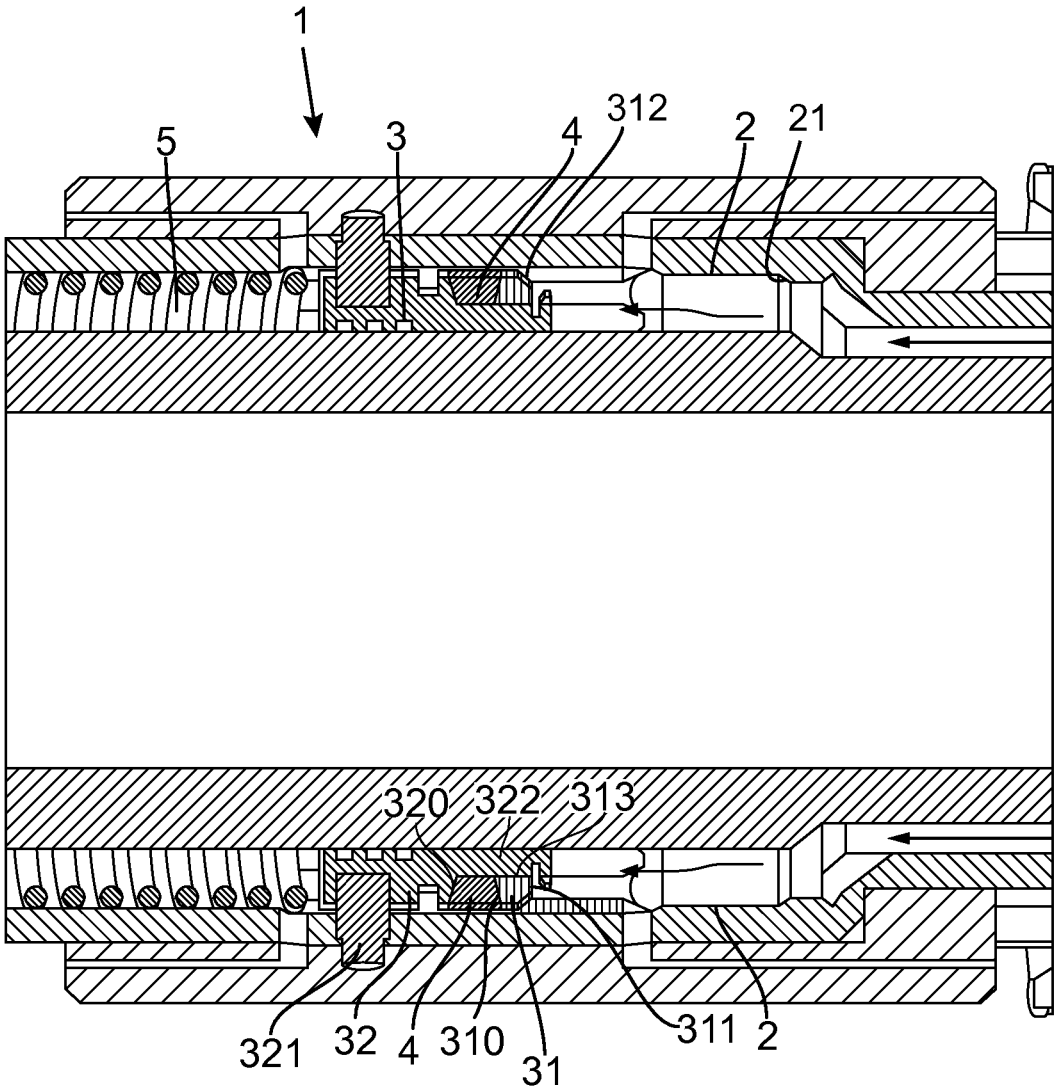
FIG. 1 shows a first embodiment of a valve with a sealing arrangement according to the invention in an open state of the valve
Figure 2:
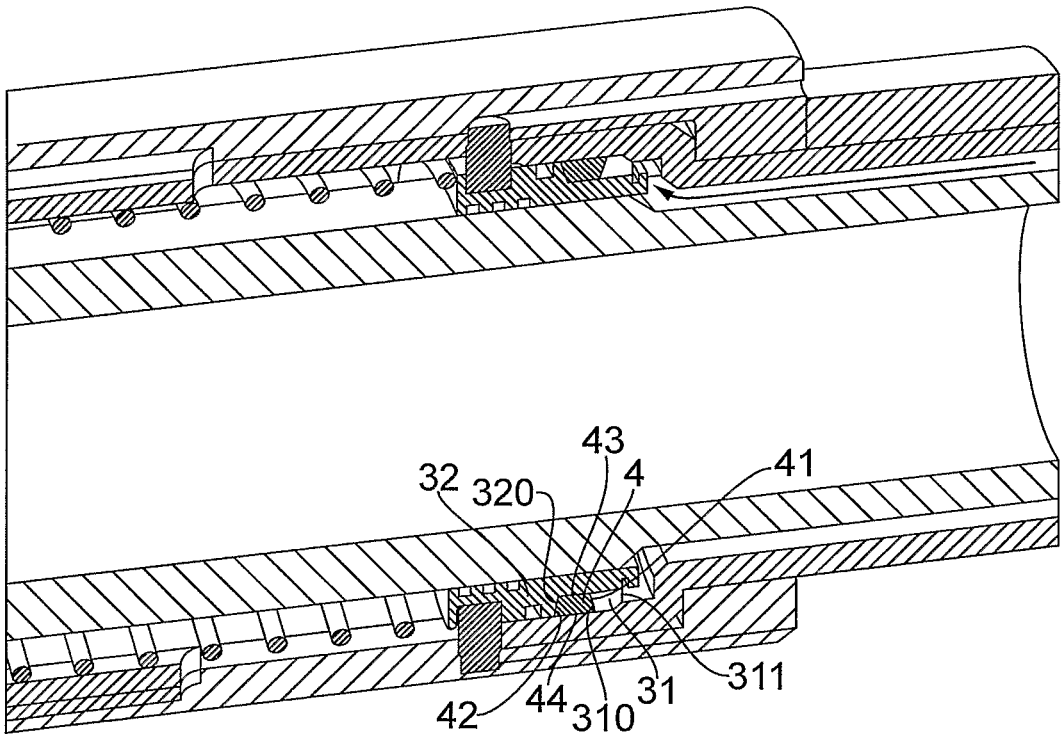
FIG. 2 shows the embodiment of FIG. 1 in a closed state of the valve.

In FIG. 1 and 2 there is shown a first embodiment of a down hole sleeve valve 1, having a valve element 3 provided with a sealing element 4. The valve element is shown in an open state of the valve in FIG. 1 and a closed state of the valve in FIG. 2. The sealing element 4 is in a closed state of the valve arranged butting against a valve seat 2, providing a closed fluid path in a closed state of the valve. The valve element 3 is in the embodiment shown formed by a sleeve-like element. The valve seat is in this embodiment also formed by a sleeve element. The valve element is moved in an axial direction for movement between an open state and a closed state. The valve seat 2 is formed by an inner surface of an outer sleeve element 2*a* facing in an inward radial direction.

The valve element 3 comprises a first part 31 and a second part 32. The second part 32 is in this embodiment formed like a sleeve element. The first element 31 is formed as a ring element and arranged around on the outside of the second part 32, connected to the second part 32 but arranged movable in an axial direction of the second part 32. The first part 31 has an inner surface, a gliding surface 313, which is abutting a guiding part 322 of the second part 32. The first part is arranged to be movable along the guiding part 322 of the second part 32. In an end of the guiding part 322 the second part 32 comprises an abutting surface 320. The abutting surface is extending in a mainly radial direction. This abutting surface 320 is facing an abutting surface 310 of the first part. The sealing element 4 is arranged between these abutting surfaces 320, 310 of the second and first part respectively. The abutting surfaces are angled so that they in a cross section as shown in the figures gives a partly V-shape. The open end of the V-shape is facing the valve seat 2. The sealing element 4 is an annular sealing element. An inner surface 43 of the sealing element 4 is abutting the guiding part 322 of the second element 32, and an outer surface 44 of the sealing element will in a closed state of the valve, be abutting the valve seat 2. Two opposite surfaces connecting the inner and outer surfaces 43,44, forms a first sealing element surface 41 and a second sealing element surface 42. These surfaces are interacting with the abutting surfaces of the first part 31 and second part 32.

The first part 31 comprises a pressure surface 311 formed by the surface of the first part 31 facing in an opposite direction of the abutting surface 310. The pressure surface will be exposed to the fluid and the pressure in the fluid when the valve is in a closed state.

In an open state of the valve, as shown in FIG. 1 a biasing spring 5 is compressed, and there is a passage through the valve as indicated by the arrows in the figure. In a closed state the spring 5 is extended and the valve element is moved in an axial direction, thereby moving the sealing element towards the valve seat 2. During this movement a stopping surface 312 of the first part 31 comes in abutment against a stopping seat 21 formed by the same element forming the valve seat 2, and in the embodiment shown arranged at an end of the valve seat 2. This interaction between the stopping seat 21 and the stopping surface will prevent the first element 31 from moving further in this one direction. The spring will then try to press the second part 32 of the valve element towards the first part 31, and since these are arranged movable relative each other, this will press the sealing element 4 in between the two abutting surfaces 310 and 320, and thereby providing a sealing pressure in the sealing element 4. The sealing element 4 will also be pressed against the valve seat 2 with this sealing pressure. In this closed state of the valve the relative configuration of the first part, the second part, the valve seat, the stopping seat and the stopping surface in addition to the closing force of the valve element, will give a given sealing pressure in the sealing element 4. In addition to this sealing pressure the first part 31 is arranged movable relative the second part 32, and if the pressure of the fluid acting on the pressure surface 311 exceeds the initial sealing pressure, this pressure will further move the first part 31 towards the second part 32 in a closed state of the valve. This movement will give an increase in the sealing pressure in the sealing element 4, thereby securing a good sealing effect for a range of pressures in the fluid.

The valve element may also be provided with a stopper element 321, formed as a part of the second part 32 of attached to the second part 32, which stopper element 31 interact with a part of the element forming the valve seat 2 and preventing the second part 32 from moving further in along the valve seat 2 in a closed state of the valve.

Figure 3:
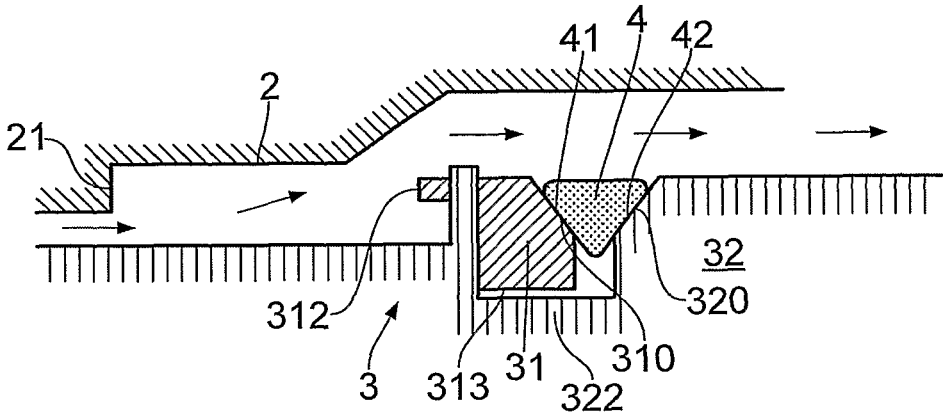
FIG. 3 shows a principle sketch of a part of a second embodiment in an open state of the valve
Figure 4:
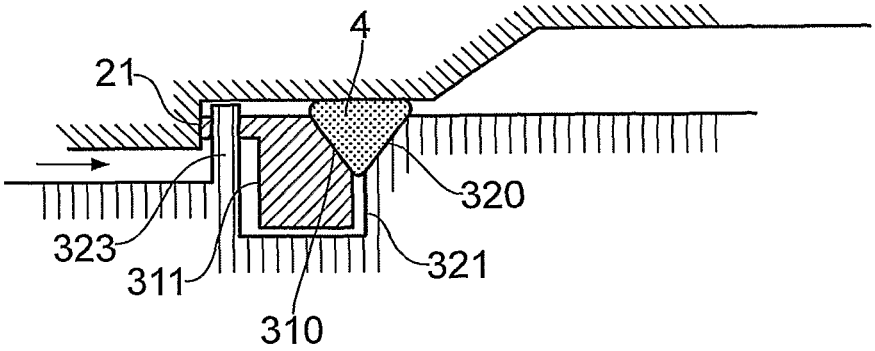
FIG. 4 shows the embodiment in FIG. 3 in a closed state

In another embodiment of the sealing arrangement, as shown with a principle sketch in FIGS. 3 and 4. The first part 31 has the similar features as in the first embodiment, indicated with the same reference numerals, with a pressure surface 311, exposed to the fluid, and an abutting surface 310 abutting the sealing element 4. The area of the pressure surface 311 is in this embodiment made larger than the area of the abutting surface 312. This gives that with an increase in the pressure in the fluid acting on the pressure surface 311 there will be an increase in the sealing pressure in the sealing element 4 which is the fluid pressure increase multiplied with the factor of the area of the pressure surface 311 seen in one direction divided with the area of the abutting surface 312 see in the same direction, thereby ensuring a higher sealing pressure in the sealing element 4 than the pressure in the fluid. By seen in one direction it should be understood as projection of the surface into one plane. This feature may be used in all the embodiments explained. Another feature not shown in the first embodiment, but which could be incorporated in the first embodiment, is the feature of the second part 32 having a protecting part 323. The protecting part 323 is arranged upstream of the first part 31, in a normal flow direction through the valve. The protecting part 323 will in an open state of the valve cover at least a part of the pressure surface 311 of the first part 31, from the flow of fluid through the valve. The protective part 323 will at least partly prevent the flowing fluid through the valve from hitting the first part 31. In the shown embodiment the protective part 323 is formed as a flange extending in a radial direction and arranged at an end of the guiding part 322 of the second part. The abutting surface 320 is arranged at the opposite end of the guiding part 322, seen in a axial direction of the second part 32. This protective part 323 will be positioned close to the pressure surface 311 in an open state of the valve, but be moved away from the pressure surface 311 in a closed state of the valve, as the first part 31 is moved relative the second part 32. The first part 31 is in this embodiment formed with the stopping surface arranged at an end of at least one rod like part of the first element 31. The rod like part extend through the protective part 323. The stopping surface 312 at the end of the rod like part will interact with the stopping seat 21 and move the first part relative to the second part 32, before the flange shape protective part comes in contact with the stopping seat 21. The configuration of the valve element is favorably so that the protective part 323 never abuts the stopping seat 21.

Figure 5:
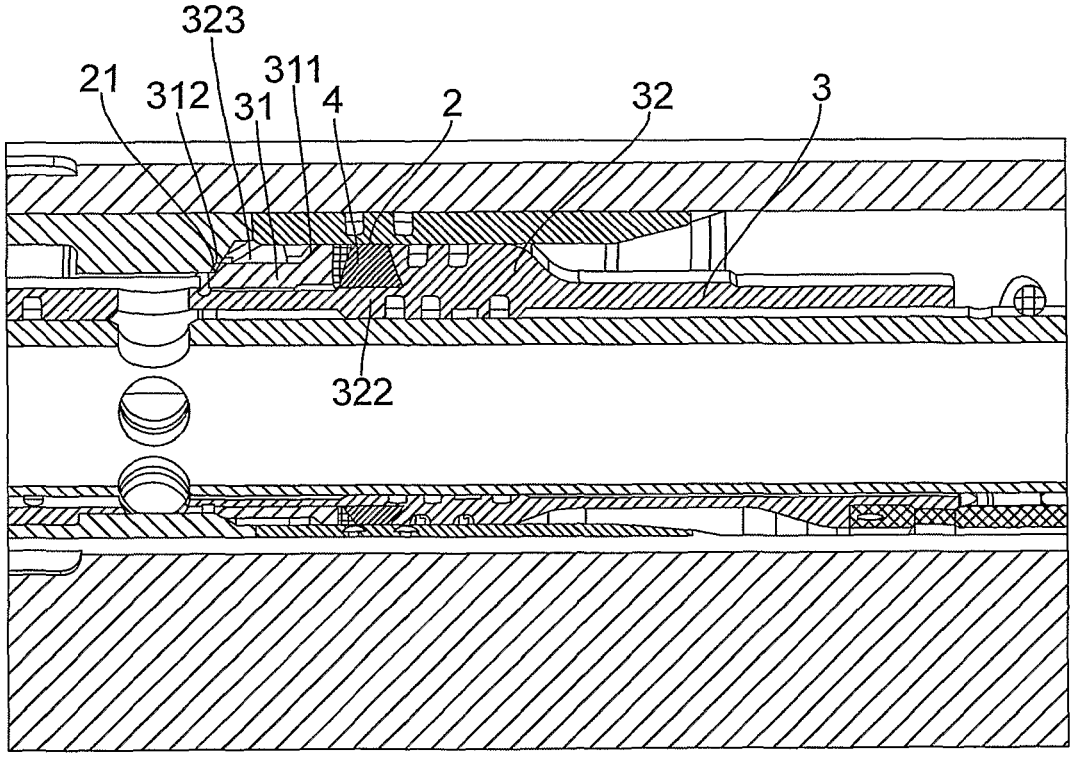
FIG. 5 shows a third embodiment of a valve with a sealing arrangement according to the invention in a closed state of the valve.

In the embodiment shown in FIG. 5 the configuration of the elements are mainly similar to the second embodiment, with the first and second part 31,32, the stopping surface 312 and stopping seat 21 and protective part 323, while the protective part 323 is formed as radially extending finger elements arranged in between rod like elements of the first part 31. Another features which may be used in all the embodiments are the configurations of the abutting surfaces 310,320 of the first and second part, which form a partly V-shape. The open end of the V-shape is in this embodiment facing away from the valve seat 2. The abutting surfaces 310,320 together with an outer surface of the guiding part 322 form a dove tail groove.

The invention has now been explained with different non-limiting embodiments. A skilled person will understand that there could be made alterations and modifications to the embodiments that are within the scope of the invention as defined in the claims. The sealing arrangement may for instance be used with a valve element in the form of a plug. The valve seat may be arranged within an outer sleeve formed valve element, the first and or second part of the valve element may comprise several elements together forming the first and or second part. The guiding part may be formed by the first element instead of the second element, the pressure surface may alternatively be formed on the second part etc.

The invention claimed is:

1. A sealing arrangement for a valve, comprising:

a first member and a second member and a flow path defined between them, one of the first member and second member having a valve seat;

a sealing element for engaging the valve seat in a closed state of the valve; and a valve element arranged between the first and second members to control flow through the flow path, the valve element comprising a sleeve part movable in an axial direction of the valve and a ring part mounted on the sleeve part and movable along the sleeve part, the sleeve part and ring part having opposing surfaces defining a gap in which the sealing element is arranged, the valve element being configured such that at least one of the opposing surfaces is movable relative to the other opposing surface in the axial direction in response to a pressure of a surrounding fluid acting on a surface of the valve element in the closed state of the valve.

2. The sealing arrangement of claim 1, wherein the opposing surfaces are angular surfaces arranged to form a partly V-shape.

3. The sealing arrangement of claim 1, wherein the sealing element is an annular shaped sealing element.

4. The sealing arrangement of claim 1, wherein one of the first and second members comprises a stopping seat arranged to abut a stopping surface of the ring part at a select axial position along the valve, thereby preventing further movement of the ring part in one direction along the axial direction while allowing movement of the ring part in another direction along the axial direction.

5. The sealing arrangement of claim 1, wherein the sleeve part comprises a protective part in opposing relation to an end surface of the ring part, the protective part being configured to cover at least a portion of the end surface of the ring part from flow of fluid through the valve in an open state of the valve.

* * * * *